US005246060A

United States Patent [19]

Fang et al.

[11] Patent Number: 5,246,060

[45] Date of Patent: Sep. 21, 1993

[54] PROCESS FOR INGOT CASTING EMPLOYING A MAGNETIC FIELD FOR REDUCING MACROSEGREGATION AND ASSOCIATED APPARATUS AND INGOT

[75] Inventors: Que-Tsang Fang, Export; Edmond S. Miksch; Gregory J. Hildeman, both of Murrysville, all of Pa.

[73] Assignee: Aluminum Company of America, Pittsburgh, Pa.

[21] Appl. No.: 792,320

[22] Filed: Nov. 13, 1991

[51] Int. Cl.[5] ..... B22D 27/02

[52] U.S. Cl. ..... 164/466; 164/502

[58] Field of Search ..... 164/466, 502, 498, 147.1

[56] References Cited

U.S. PATENT DOCUMENTS

| | | |
|---|---|---|
| Re. 32,529 | 10/1987 | Vives . |
| 1,721,357 | 7/1929 | Siler . |
| 2,861,302 | 8/1956 | Mann et al. . |
| 2,944,309 | 9/1954 | Schaaber . |
| 3,842,895 | 10/1974 | Mehrabian et al. . |
| 3,911,997 | 10/1975 | Sugazawa et al. . |
| 4,014,379 | 3/1977 | Getselev . |
| 4,126,175 | 11/1978 | Getselev . |
| 4,321,959 | 3/1982 | Yarwood et al. . |
| 4,446,909 | 5/1984 | Yarwood et al. . |
| 4,458,744 | 7/1984 | Yarwood et al. . |
| 4,495,981 | 1/1985 | Kindlmann et al. . |
| 4,523,628 | 6/1985 | Vives . |
| 4,530,404 | 7/1985 | Vives . |
| 4,709,747 | 12/1987 | Yu et al. . |
| 4,723,591 | 2/1988 | Vives et al. . |
| 4,933,005 | 6/1990 | Mulcahy et al. . |

FOREIGN PATENT DOCUMENTS

| | | | |
|---|---|---|---|
| 58-163566 | 3/1982 | Japan . | |
| 61-199557 | 9/1986 | Japan | 164/466 |
| 1-245952 | 10/1989 | Japan | 164/466 |
| 1-271031 | 10/1989 | Japan | 164/466 |
| 187255 | 10/1966 | U.S.S.R. . | |

OTHER PUBLICATIONS

Pirich et al., "Thermal and Solutal Convection Damping Using an Applied Magnetic Field", Washington Microgravity *Sci and Appl.*, NAS8-34922, pp. 77-78, May 1985.

M. D. Sahu et al., "Effects of Electromagnetic Fields on Solidification of Some Aluminium Alloys", British Foundryman, vol. 70, Part III, pp. 89-92, (1977).

R. Ambardar, et al., Grain Coarsening by Solidification in a Steady Magnetic Field, Aluminum, vol. 62(6), pp. 446-448, (Jun. 1986).

R. Ambardar et al., "Effect of Steady Magnetic Field on the Structure of Unidirectionally Solidified Metal Alloy Castings", Transactions of the Indian Institute of Metals, vol. 40, No. 1, Feb. 1987, pp. 22-26.

D. R. Uhlmann, et al., "The Effect of Magnetic Fields on the Structure of Metal Alloy Castings", Transaction of the Metallurgical Society of AIME, vol. 236, Apr., 1966 pp. 527-531.

*Primary Examiner*—Kuang Y. Lin

*Attorney, Agent, or Firm*—Craig G. Cochenour; David W. Pearce-Smith

[57] ABSTRACT

A process of reducing macrosegregation in the casting of a metal alloy ingot is disclosed. The process includes introducing a molten metal alloy into a casting mold cavity, cooling the molten metal alloy to form a solid zone, a liquid-solid mushy zone overlying the solid zone, a liquid zone overlying the liquid-solid mushy zone and a melt surface on the liquid zone, employing during the cooling at least one substantially static magnetic field having at least two planes of symmetry which intersect on the longitudinal axis of the ingot, generating the magnetic field by at least one coil means having an inner region through which the metal alloy passes, energizing the coil means by a substantially static electrical current wherein the current follows a path defined by the coil means and passes around at least one of the molten metal alloy and the zones, and dampening convection flows of the molten metal alloy which cause macrosegregation by means of the magnetic field. An associated apparatus suitable for casting metal alloys and an improved ingot having a refined equiaxed grain structure and a reduced pore size are provided.

21 Claims, 6 Drawing Sheets

PROCESS FOR INGOT CASTING EMPLOYING A MAGNETIC FIELD FOR REDUCING MACROSEGREGATION AND ASSOCIATED APPARATUS AND INGOT

BACKGROUND OF THE INVENTION

1. Field of the Invention

This invention relates to a process and apparatus for reducing macrosegregation in the casting of a metal alloy ingot employing at least one substantially static magnetic field that forms the basis of an improved ingot having a fine, equiaxed grain structure and a reduced porosity.

2. Brief Description of the Prior Art

Controlling segregation in metal alloy castings, such as for example aluminum alloy ingots, to maintain a desired uniform concentration of alloying elements throughout the ingot is of particular importance in the production of high quality metal alloy ingots. Macrosegregation is a term which is used to describe segregation on a scale which is comparable to the dimensions of the ingot. It is distinct from microsegregation, which is on the scale of the spacing between the dendrite branches.

It is well known by those skilled in the art that large ingots of metal alloys usually exhibit macrosegregation which depletes the central region of the ingot of alloying ingredients. Since the alloying ingredients increase strength, this depletion results in weakened metal in the center of the ingot.

Various processes and apparatus for reducing segregation in metal alloy castings have been known, and various processes and apparatus have been used for controlling grain structure. However, none teach or suggest the improved results of the process and apparatus of the present invention.

U.S. Pat. No. 2,861,302 discloses an apparatus for the continuous casting of molten alloys, such as aluminum alloys, wherein the partially solidified material in the mold is subjected to an alternating magnetic field to cause a stirring in the molten metal. This patent states that the stirring equalizes the temperature in the casting and provides a desired structural texture.

U.S. Pat. No. 3,842,895 discloses an apparatus for reducing microsegregation and macrosegregation in metal alloy castings. It states that the apparatus reduces such segregations in continuous metal alloy castings by withdrawing heat from one region of the liquid metal in the mold to effect solidification and simultaneously adding heat to the liquid metal in a controlled manner for reducing the width of the liquid-solid mushy zone that exists between the liquidus and solidus isotherms. It states that the liquid metal alloy introduced into the mold is superheated and convection in the liquid melt within the mold is retarded by employing a transverse magnetic field.

U.S. Pat. No. 3,911,997 discloses an apparatus for metal casting for preventing microsegregation and macrosegregation at the center of a continuously cast ingot. It employs a superconducting solenoid magnet within an insulated vessel disposed in the vicinity of one side of a mold for setting up a magneto-static field in the liquid metal within the mold.

U.S. Pat. No. 4,723,591 discloses an apparatus for regulating the level of the line of contact of the free surface of a metal with a mold used in vertical casting of aluminum alloys. It discloses that the mold is surrounded by at least one annular coil in which at least one alternating electrical current is passed.

U.S. Pat. No. 4,933,005 discloses an induction stirring method including electromagnetically inducing stirring of molten metal for inducing turbulence in the molten metal and then applying a static magnetic field to minimize the turbulence induced by the electromagnetic stirring.

U.S. Pat. No. 4,709,747 discloses a casting process for aluminum alloys that involves weakening the flow currents within the liquid pool of molten metal by mechanically increasing the internal friction of the liquid pool of molten metal. It discloses an apparatus that includes a mechanical damper consisting of two or more parallel plates or concentric rings for reducing turbulence within the pool.

U.S. Pat. No. 4,530,404 and Reissue U.S. Pat. No. Re. 32,529 disclose a process for the electromagnetic casting of metals and alloys including using simultaneously a stationary electromagnetic field and a variable electromagnetic field for producing radial vibrations within the metal and for limiting the mixing effect.

U.S. Pat. No. 4,523,628 discloses a process for casting metals and continuous casting of aluminum alloys including simultaneously applying a stationary magnetic field and a variable magnetic field for generating radial vibrations in the metal.

Methods and apparatus for electromagnetic casting of metal and alloy ingots having portions of small radius of curvature are disclosed in U.S. Pat. Nos. 4,321,959 and 4,458,744. These patents state that the apparatuses include a modified shield or screening means for reducing the electromagnetic field intensity at the corners of the forming ingot by increasing local screening of the field at the corners and for reducing the containment force at the outer peripheral surface of the molten material, respectively. They disclose a modified inductor excited by an alternating current.

U.S.S.R. Patent No. 187,255 discloses ingot casting employing inner and outer electrodes positioned in the molten metal of an ingot as it forms in the mold. It states that a potential difference supplied to the inner and outer electrodes sets up a permanent radial field between them while the current passing along the central electrode sets up a permanent azimuthal field. The azimuthal field cooperates with the radial field to set up volumetric forces in a metal enclosed between the electrodes.

U.S. Pat. No. 2,944,309 discloses a continuous casting mold for casting metal alloys having a water-cooled jacket and electrical means that surrounds the body of the continuous casting mold for forming an exteriorly applied rotating magnetic field.

U.S. Pat. No. 1,721,357 discloses a process for treating metallic bodies by magnetic force to render the metallic bodies heat resistant. It states that the process prevents a change in the form of the metallic body when it is subjected to high temperatures.

Japanese Patent No. 58,163,566 discloses an iron-chromium-cobalt type alloy that is prepared by melting the alloy and pouring it into a mold placed between electromagnets producing a magnetic field. It states that the melt is solidified in the mold in a magnetic field wherein convection of the melt is prevented. The solidified alloy is kept at a temperature of 550 to 700 degrees Centigrade before aging treatment is carried out on the ingot.

Sahu, M. D., et al., "Effects of electromagnetic fields on solidification of some aluminum alloys", *British Foundryman,* Vol. 70, Part III, pp. 89–92 (1977), discloses that electromagnetic stirring applied externally influences the cast grain of aluminum-copper and aluminum-magnesium alloys.

Ambardar, R. et al., "Grain Coarsening by Solidification in a Steady Magnetic Field" *Aluminum,* 62, (6), pp. 446–448, June 1986, discloses the grain coarsening effect of a steady magnetic field on structure formation in an aluminum-4% copper alloy cast into a sodium silicate bound sand mold.

Ambardar, R., et al., "Effect of steady magnetic field on the structure of unidirectionally solidified alloy castings", *Transactions of the Indian Institute of Metals,* Vol. 40, No. 1, pp. 22–26, February, 1987, discloses that a steady magnetic field was used to suppress the thermal convection during unidirectional solidification of aluminum-copper castings having a completely columnar structure.

Uhlmann, D. R., et al., "The Effect of Magnetic Fields on the Structure of Metal Alloy Castings", *Transaction of the Metallurgical Society of AIME,* Vol. 236, pp. 527–531, April 1966, discloses a magnetic field used to damp out liquid convection during the solidification of metal alloy castings to inhibit columnar-to-equiaxed transition and the production of a structure that is columnar to the center of the casting.

Pirich, R. G., et al., "Thermal and solutal convention damping using an applied magnetic field", *Washington Microgravity Sci. and Appl.,* NAS 8-34922, pp. 77–78, May 1985, discloses a comparison of eutectic bismuth-/manganese alloy samples grown in a transverse magnetic field to samples grown without the magnetic field present. It states that samples grown at velocities below 3 cm/h (centimeters/hour) in the magnetic field show little or no deviation in eutectic morphology from those samples grown without an applied field.

In spite of these prior art disclosures, there remains a very real and substantial need for a process and apparatus for reducing undesired macrosegregation in the casting of a metal alloy ingot. Such a process and apparatus is disclosed herein and may be employed to create an improved ingot which has a refined equiaxed grain structure and a reduced pore size.

SUMMARY OF THE INVENTION

The present invention has met the above-described need. The process and apparatus of the present invention provide an efficient and economical approach to reducing macrosegregation in the casting of a metal alloy ingot.

The process of the present invention includes introducing a molten metal alloy into a casting mold cavity, cooling the molten metal alloy to form a solid zone, a liquid-solid mushy zone overlying the solid zone, a liquid zone overlying the liquid-solid mushy zone and a melt surface on the liquid zone, employing during the cooling at least one substantially static magnetic field having at least two planes of symmetry which intersect on the longitudinal axis of the ingot, generating the magnetic field by at least one coil means having an inner region through which the metal alloy passes, energizing the coil means by a substantially static electrical current, and dampening convection flows of the molten metal alloy by means of the magnetic field. This process includes producing an improved ingot characterized by a refined equiaxed grain structure and a reduced pore size.

This process may include mixing a grain refining agent with the molten metal alloy prior to introducing the molten metal alloy into the casting mold.

This process may be employed in the casting of metal alloy ingots, such as for example aluminum alloys selected from the group consisting of 2xxx, 3xxx, 5xxx and 7xxx alloy series.

The apparatus of this invention includes a casting mold which defines the perimeter of the ingot cross-section, cooling means for cooling the casting mold and the ingot as it emerges from the casting mold to effect solidification of the molten metal alloy, and at least one coil means for creating a substantially static magnetic field having at least two planes of symmetry which intersect on the longitudinal axis of the ingot.

It is an object of the present invention to provide a process and apparatus for reducing macrosegregation in the casting of a metal alloy ingot.

It is another object of the present invention to provide a process and apparatus for reducing undesired convection in a molten metal alloy.

It is another object of the present invention to provide a process and apparatus for reducing macrosegregation in the casting of an aluminum alloy ingot that includes generating at least one substantially static magnetic field having at least two planes of symmetry which intersect on the longitudinal axis of the ingot.

It is another object of the present invention to provide a process and apparatus for molding an aluminum alloy selected from the group consisting of 2xxx, 3xxx, 5xxx and 7xxx alloy series.

It is another object of the present invention to provide a process and apparatus that produces an ingot having a refined equiaxed grain structure and a reduced pore size.

It is another object of the present invention to provide a process and apparatus that is economical and compatible with existing aluminum alloy casting technology.

It is another object of this invention to provide an improved product that has a refined equiaxed grain structure and a reduced pore size.

These and other objects of the invention will be more fully understood from the following descriptions of the invention, the drawings and the claims appended hereto.

DESCRIPTION OF THE PREFERRED EMBODIMENTS

Figure 1A:
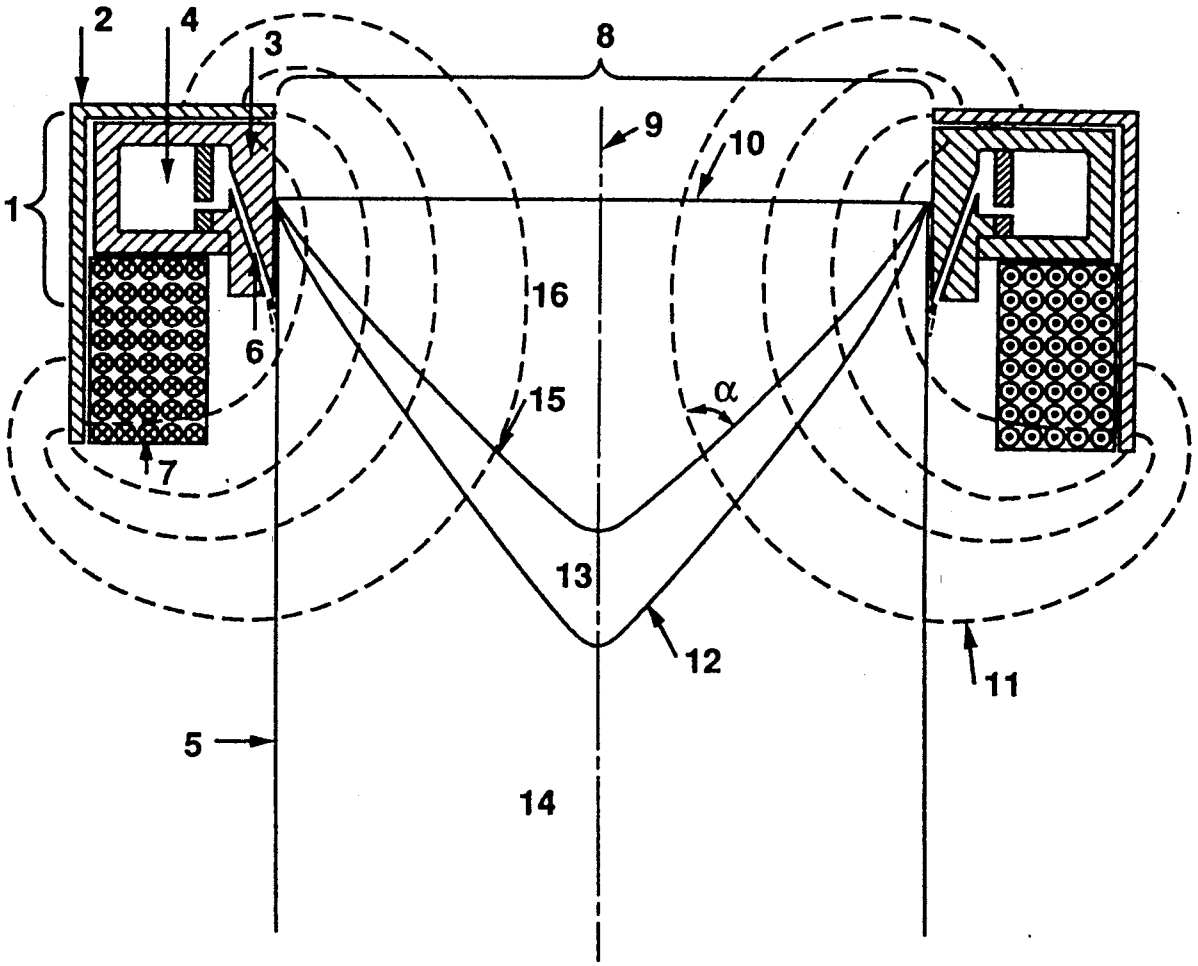
FIG. 1(A) shows a schematic cross-section of a form of the apparatus of this invention having coil means positioned around the exterior of the casting mold cavity and below the casting mold.

The process and apparatus of this invention provide for the reduction of macrosegregation in the casting of metal alloy ingots.

As employed herein "casting" includes semicontinuous and continuous casting of metal alloys of various shapes and includes bi-level casting, level pour casting, and horizontal systems well known by those skilled in the art. Additionally, as employed herein "casting mold" includes a direct chill mold such that a solid forms in the cavity of the mold capable of supporting the V-shaped pool of liquid in the center of the casting.

As used herein, "coil means" includes a single coil or a plurality of coils cooperating to create substantially the same substantially static magnetic field as could be achieved by one coil.

As employed herein "substantially static magnetic field" means a direct current magnetic field.

As employed herein "substantially static electrical current" means a direct current. As employed herein "direct current" means a current in which (A) the flow of charges is all in one direction for the period of time under consideration and (B) the magnitude is generally constant except with minor pulsations in its amplitude.

As used herein, all percentages refer to weight percent (wt. %).

As used herein, the expression "planes of symmetry" means that each plane represents a division of the substantially static magnetic field into mirror-image segments.

The process of this invention includes introducing a molten metal alloy into a casting mold cavity, cooling the molten metal alloy to form a solid zone, a liquid-solid mushy zone overlying the solid zone, a liquid zone overlying the liquid-solid mushy zone and a melt surface on the liquid zone, employing during the cooling at least one substantially static magnetic field having at least two planes of symmetry which intersect on the longitudinal axis of the ingot, generating the magnetic field by at least one coil means having an inner region through which the metal alloy passes, energizing the coil means by a substantially static electrical current wherein the current follows in a path defined by the coil means and passes around at least one of the molten metal alloy and the hereinbefore mentioned zones, and dampening convection flows of the molten metal alloy which cause macrosegregation by means of the magnetic field.

This process employs a mold wherein the casting mold defines the perimeter of the cross-section of the metal alloy ingot produced. For example, in the casting of a round metal alloy ingot, the casting mold cavity is in the form of a hoop or ring with an inside diameter approximately equal to the diameter of the metal alloy ingot which is to be produced. For casting a rectangular metal alloy ingot, the mold cavity is in the form of a rectangle that encloses a rectangular space defining the cross-section of the metal alloy ingot which is to be produced. The substantially static magnetic field is generated by at least one coil means which has the same symmetry as the ingot which is to be produced. Thus, it will be appreciated by those skilled in the art that the coil means may be various shapes such as for example (A) noncircular if the casting mold cavity has a noncircular shape such as, for example, a rectangular coil if the casting mold cavity has a rectangular shape, a square coil if the casting mold cavity has a square shape or an elliptical coil if the casting mold cavity has an elliptical shape, or (B) a circular coil if the casting mold cavity has a circular shape.

The rectangular coil means generates a substantially static magnetic field having two planes of symmetry. These planes are perpendicular to each other and each plane includes the centerline of the metal alloy ingot. These planes divide the ingot into four symmetrical quadrants. Each of such quadrants formed by these two planes receive equivalent intensities of the substantially static magnetic field and have equivalent concentrations of alloying constituents, thus contributing to the uniformity of the metal alloy ingot.

The processes of the invention described herein include a process employing as the metal alloy an aluminum alloy selected from the group consisting of 2xxx, 3xxx, 5xxx and 7xxx alloy series. For example, the processes of this invention may include employing alloy 2124, alloy 3004, alloy 7050, or alloy 7075.

The aluminum alloys of the present invention may include impurity levels which are commercially acceptable in such alloys.

In another embodiment of this invention, this process includes mixing a grain refining agent with the molten metal alloy prior to introducing the molten metal alloy into the casting mold cavity.

This invention includes introducing the molten metal alloy into a first end of the casting mold cavity to establish a flow of the molten metal alloy toward a second end of the casting mold cavity. As the molten metal alloy flows in the casting mold cavity, it cools. This cooling creates both (A) an interface at the liquid-solid mushy zone and the solid zone and (B) an interface at the liquid-solid mushy zone and the liquid zone. These interfaces are established as the molten metal alloy cools to form the solid zone thereby producing the ingot. The substantially static magnetic field is represented by flux lines. The process of this invention includes passing each flux line through a point on a line which is tangent to the interface between the liquid-solid mushy zone and the liquid zone at an angle greater than about 20 degrees. This process preferably involves introducing the molten aluminum alloy into the casting mold cavity to provide a liquid pool which supplies the metal alloy to the interface between the liquid zone and the liquid-solid mushy zone.

In another embodiment of this invention, the process includes employing at least one coil means having an inner region through which the metal alloy may pass. This process includes casting the ingot in a casting mold cavity having a desired shape such as for example, a noncircular shape or a circular shape. The shape of the casting mold cavity may include a noncircular or circular shape having core means within the casting mold cavity such that the ingot formed has a hollow portion. The coil means employed may be of a desired shape which is the same as and is dependent upon the shape of the particular casting mold cavity employed. This process includes positioning at least one coil means generally above the casting mold cavity.

In another embodiment of this invention, the process includes positioning at least one coil means generally below the casting mold. Preferably, this process includes disposing an inner surface of the coil means within about 2 to 6 centimeters from an outer surface of the ingot.

In a most preferred embodiment this process includes casting the ingot in a casting mold cavity having a rectangular shape and includes (A) positioning at least one rectangular shaped coil means generally below the casting mold and (B) positioning an inner surface of the coil means within about 2 centimeters to 6 centimeters from an outer surface of the ingot.

In another embodiment of this invention, the process includes positioning at least one coil means around the exterior of the casting mold cavity. Generally, when the coil means is a coil which has an opening with a greater transverse dimension than the transverse dimension of the casting mold cavity, the wires of the coil wind about the circumference of the casting mold cavity in a direction that is transverse to the longitudinal axis of the casting mold cavity.

In another embodiment of this invention, the process includes positioning at least one coil means around the exterior of the casting mold and in part below the casting mold.

In yet another embodiment of this invention a process is provided that includes positioning a plurality of coil means generally below the casting mold, above the casting mold, or around the exterior of the casting mold, and combinations thereof. This process includes employing the substantially static electrical current in each of the coil means in the same direction.

In another embodiment of this invention the process includes employing a magnetic field having an intensity of at least about 500 gauss.

In another embodiment of this invention, the process includes employing at least one coil means having an inner region through which the metal alloy passes wherein this inner region has a smaller transverse dimension than the transverse dimension of the casting mold. This process includes positioning at least one coil means having an inner region with a smaller transverse dimension than the transverse dimension of the casting mold generally above the casting mold cavity.

It will be appreciated by those skilled in the art that the processes of this invention described herein include adjusting the substantially static electrical current energizing the coil means such that the convection of the molten metal alloy is reduced to a predetermined level.

In general, the coil means includes at least one coil having water-cooled copper tubing with an outside diameter of about 0.50 centimeters to 1.50 centimeters and receives an imposed substantially static electrical current of about 500 to 1500 amperes.

The process of the invention may include forming the ingot in conventional continuous or semi-continuous casting mold arrangements well known by those skilled in the art.

Employing the process of the present invention results in an ingot having a refined equiaxed grain structure. This unexpected result is in contrast to earlier teachings disclosing that a magnetic field produces a transition to coarse columnar grains.

The process of this invention includes producing an ingot having a reduced pore size in comparison to the pore size of an ingot produced in the absence of a magnetic field. The magnetic field substantially reduces or eliminates large gas pores in the cast ingot due to hydrogen in the melt and thereby results in an ingot with reduced pore size.

Another embodiment of the invention is an apparatus for reducing undesired macrosegregation in the casting of a metal alloy ingot. This apparatus includes a casting mold cavity for receiving a molten metal alloy, cooling means for cooling the casting mold cavity to effect solidification of the molten metal alloy, and at least one coil means for receiving a substantially static electrical current in order to generate at least one substantially static magnetic field having at least two planes of symmetry which intersect on the longitudinal axis of the ingot.

A preferred embodiment of this invention includes an apparatus as hereinbefore described wherein at least one coil means is positioned generally below the casting mold.

In a most preferred embodiment of this invention, the apparatus includes at least one coil means positioned generally below the casting mold and wherein an inner surface of the coil means is disposed within about 2 to 6 centimeters from an outer surface of the ingot.

Another embodiment of this invention includes an apparatus as hereinbefore described wherein at least one coil means is positioned generally around the exterior of the casting mold.

Another embodiment of this invention includes an apparatus as hereinbefore described wherein the coil means is positioned generally above the casting mold.

In yet another embodiment of this invention, the apparatus as hereinbefore described includes at least one coil means positioned generally around the exterior of the casting mold and in part below the casting mold.

In another embodiment of this invention, the apparatus includes coil means which are disposed in at least one of the positions selected from the group consisting of (A) generally below the casting mold, (B) generally above the casting mold, (C) generally around the exterior of the casting mold, and (D) generally around the exterior of the casting mold and in part below the casting mold.

It will be appreciated by those skilled in the art that the apparatus as hereinbefore described may have a casting mold and coil means of a desired shape. For example, when the casting mold has a circular shape, the coil means has at least one coil that has an annular shape. When the casting mold has a noncircular shape, the coil means has at least one coil that has a noncircular shape. For example, the casting mold and coil may each have a rectangular, square or elliptical shape.

FIG. 1(A) illustrates one form of the direct current magnetic damping apparatus of the present invention. In FIG. 1(A), a direct chill mold 1 is shown including a steel flux path 2 and cooling means 3 that includes a water box 4. Reference numeral 5 identifies the side wall of the ingot which has emerged from the mold 1. Cooling water is discharged from the water box 4 and flows through passageway 6 in such a direction so as to communicate with the side wall of the ingot 5. As shown in FIG. 1(A), a field coil 7, which is energized by a substantially static electrical current, has an inner region with a greater transverse dimension than the transverse dimension of the casting mold cavity 8. Field coil 7 is positioned generally around the exterior of the casting mold and in part below the casting mold. Reference numerals 9 and 10 refer to the longitudinal axis of the ingot and the melt surface, respectively. It will be understood by those skilled in the art from FIG. 1(A) that the magnetic field has an axis of symmetry disposed within the casting mold cavity and oriented generally parallel to the direction of casting and that the magnetic field flux lines 11 reduce undesired convection in the molten metal alloy. In FIG. 1(A), reference numeral 12 refers to the interface between the liquid-solid mushy zone 13 and the solid zone (solidified ingot) 14. Reference numeral 15 refers to the interface between the liquid-solid mushy zone 13 and the liquid zone (pool) 16. The molten metal alloy which may contain a grain refining agent is introduced into the casting mold cavity to establish a generally vertical gravitational flow of the refined molten metal alloy. FIG. 1(A) shows that each magnetic field flux line 11 passes through a point on a line (not shown) which is tangent to the interface between the liquid-solid mushy zone 13 and the liquid zone 16 at an angle $\alpha$ that is greater than about 20 degrees.

The effectiveness with which a substantially static magnetic field reduces the velocity of a flowing molten metal alloy is characterized by the damping time. For example, a quantity of molten metal alloy in a substantially direct current created magnetic field is assumed to have an initial velocity which is reduced by interaction with the magnetic field. The liquid metal, moving across magnetic field lines, generates an electromotive force (emf) which tends to cause electrical current to flow in the metal. This flow will occur if current return paths are available. In an ideal case for which current paths have zero resistance, or in which current return paths have generated emfs due to their own motion, the following formula provides the damping time of the motion. The damping time is proportional to the density of the liquid metal and inversely proportional to its electrical conductivity. The damping time is also inversely proportional to the square of the magnetic field strength. For non-ideal cases for which currents are reduced by ohmic losses in the current return paths, the same proportionalities generally apply. For many non-ideal cases, such as the present case of liquid aluminum contained within the solid aluminum ingot, the damping time is longer by a small factor such as 2 when compared with the ideal case. For an example of an ideal case, in a field of 0.1 TESLA, liquid aluminum with an initial velocity of 1 meter/second is decelerated to a velocity of 0.3678 meter/second in a time of 0.0592 seconds. After an additional time of 0.0592 seconds, it is decelerated further to a velocity of 0.1353 meter/-second.

Figure 1B:
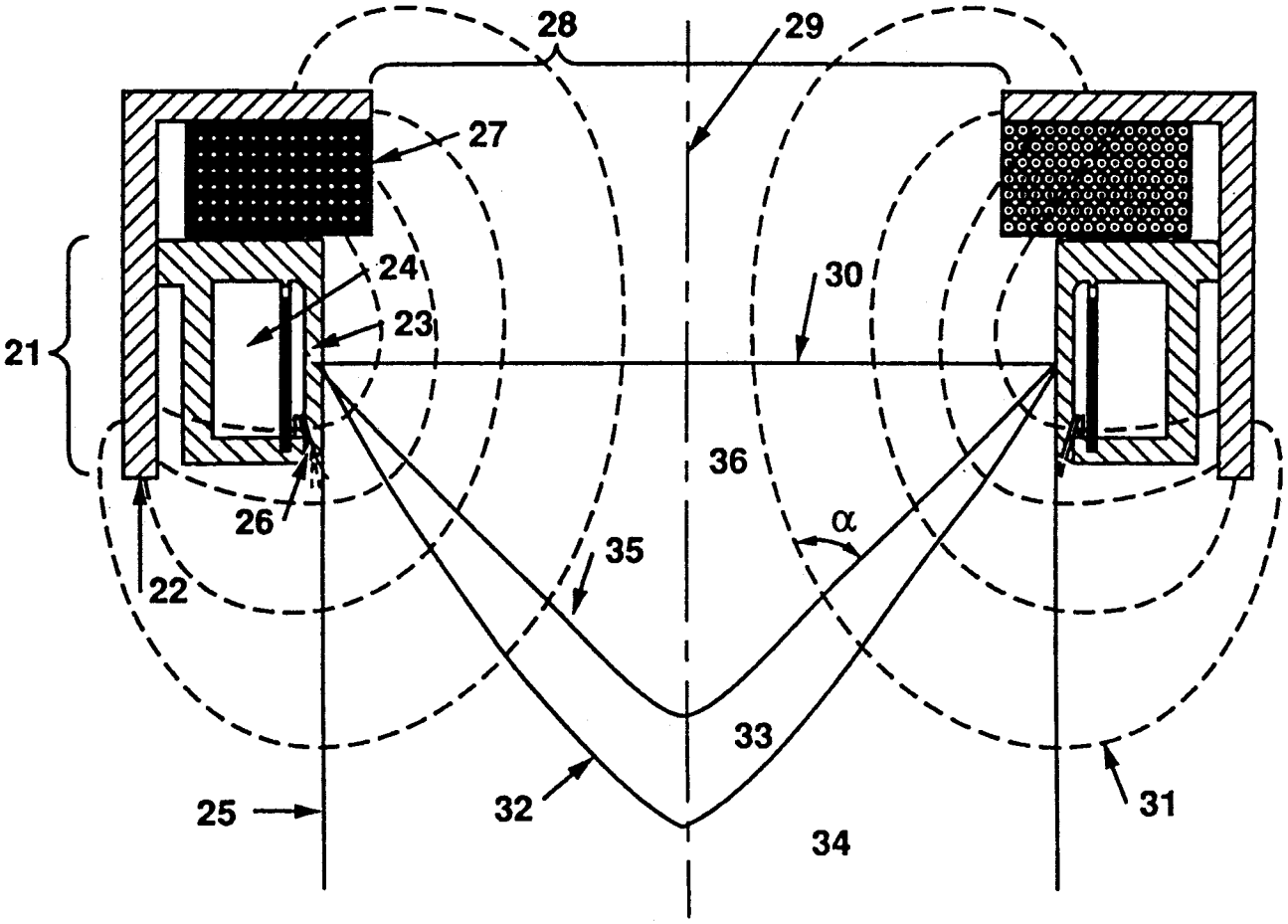
FIG. 1(B) shows a schematic cross-section of a form of the apparatus of this invention having coil means positioned above the casting mold.

FIG. 1(B) illustrates another form of the direct current magnetic damping apparatus of the present invention. In FIG. 1(B), a mold 21 is shown including a steel flux path 22 and cooling means 23 that includes a water box 24. Reference numeral 25 identifies the side wall of the ingot which has emerged from the mold 21. Cooling water is discharged through passageway 26 from the water box 24 and flows in such a direction so as to communicate with the side wall of the ingot 25. As shown in FIG. 1(B), a field coil 27 is energized by a substantially static electrical current. Field coil 27 having interior 28 is positioned generally above the casting mold. Reference numerals 29 and 30 refer to the longitudinal axis of the casting mold cavity and the melt surface, respectively. It will be understood by those skilled in the art from FIG. 1(B) that the magnetic field has an axis of symmetry disposed within the casting mold cavity and oriented generally parallel to the direction of casting and that the magnetic field flux lines 31 reduce undesired convection in the molten metal alloy. In FIG. 1(B), reference numeral 32 refers to the interface between the liquid-solid mushy zone 33 and the solid zone (solidified ingot) 34. Reference numeral 35 refers to the interface between the liquid-solid mushy zone 33 and the liquid zone (pool) 36. The molten metal alloy which may contain a grain refining agent is introduced into the casting mold cavity. FIG. 1(B) shows that each magnetic field flux line 31 passes through a point on a line (not shown) which is tangent to the interface between the liquid-solid mushy zone 33 and the liquid zone 36 at an angle $\alpha$ that is greater than about 20 degrees.

Figure 1C:
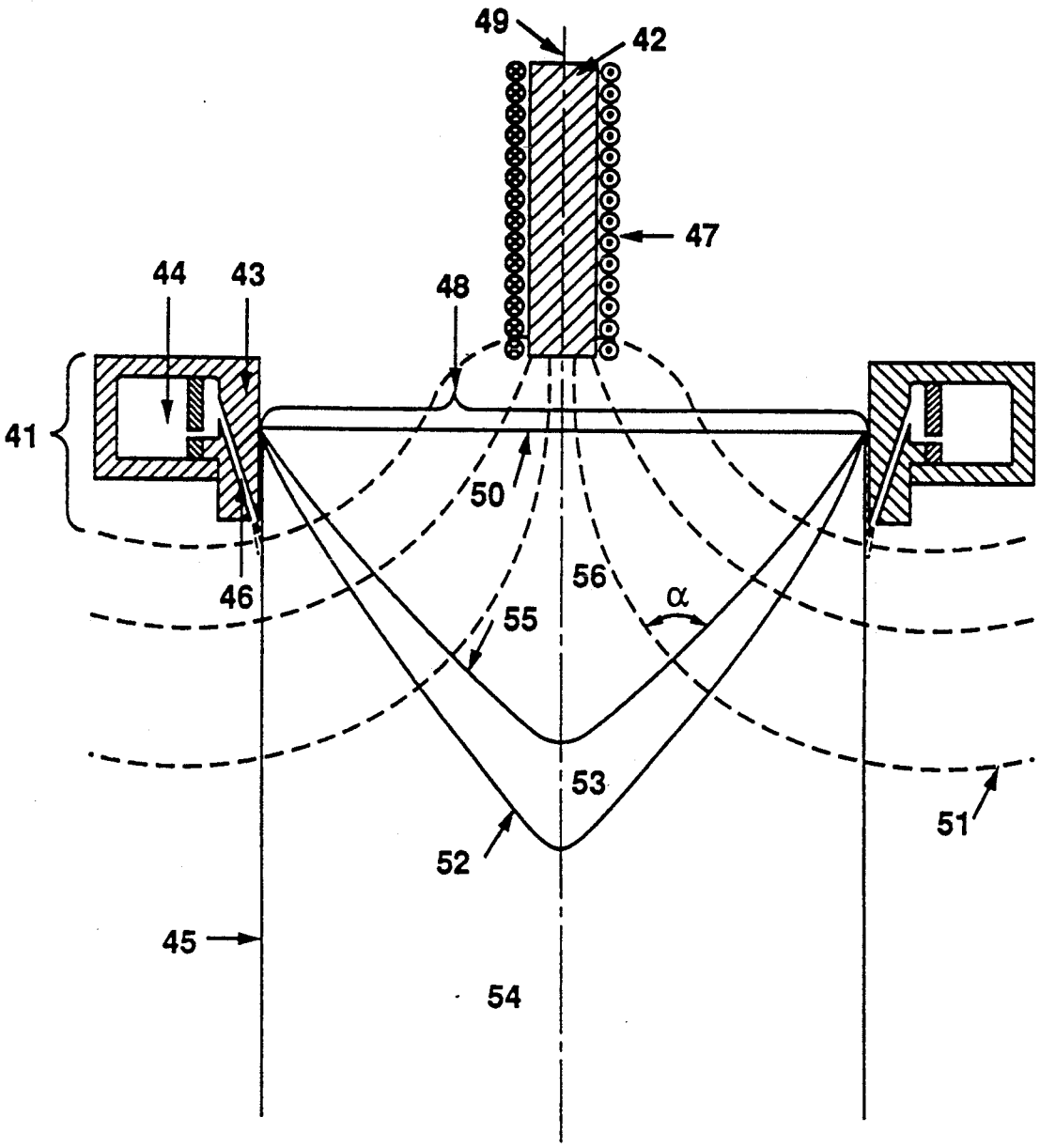
FIG. 1(C) shows a schematic cross-section of a form of the apparatus of this invention having coil means positioned coaxially with the longitudinal axis of the ingot and above the casting mold.

FIG. 1(C) illustrates one form of the direct current magnetic damping apparatus of the present invention. In FIG. 1(C), a mold 41 is shown including a steel flux path 42 and cooling means 43 that includes a water box 44. Reference numeral 45 identifies the side wall of the ingot which has emerged from the mold 41. Cooling water is discharged from the water box 44 and flows through passageway 46 in such a direction so as to communicate with the side wall of the ingot 45. As shown in FIG. 1(C), a field coil 47, which is energized by a substantially static electrical current, has an inner region with a smaller transverse dimension than the transverse dimension of the casting mold cavity 48 and is positioned coaxially with the longitudinal axis of the ingot 49 and generally above the casting mold cavity. Reference numeral 50 refers to the melt surface. It will be understood by those skilled in the art from FIG. 1(C) that the magnetic field has an axis of symmetry disposed within the mold cavity and oriented generally parallel to the direction of casting and that the magnetic field flux lines 51 reduce undesired convection in the molten metal alloy. In FIG. 1(C), reference numeral 52 refers to the interface between the liquid-solid mushy zone 53 and the solid zone (solidified ingot) 54. Reference numeral 55 refers to the interface between the liquid-solid mushy zone 53 and the liquid zone (pool) 56. The molten metal alloy which may contain a grain refining agent is introduced into the casting mold cavity to provide a liquid pool which supplies the metal alloy to the interface between the liquid zone and the liquid-solid mushy zone. FIG. 1(C) shows that each magnetic field flux line 51 passes through a point on a line (not shown) which is tangent to the interface between the liquid-solid mushy zone 53 and the liquid zone 56 at an angle $\alpha$ that is greater than about 20 degrees.

Figure 1D:
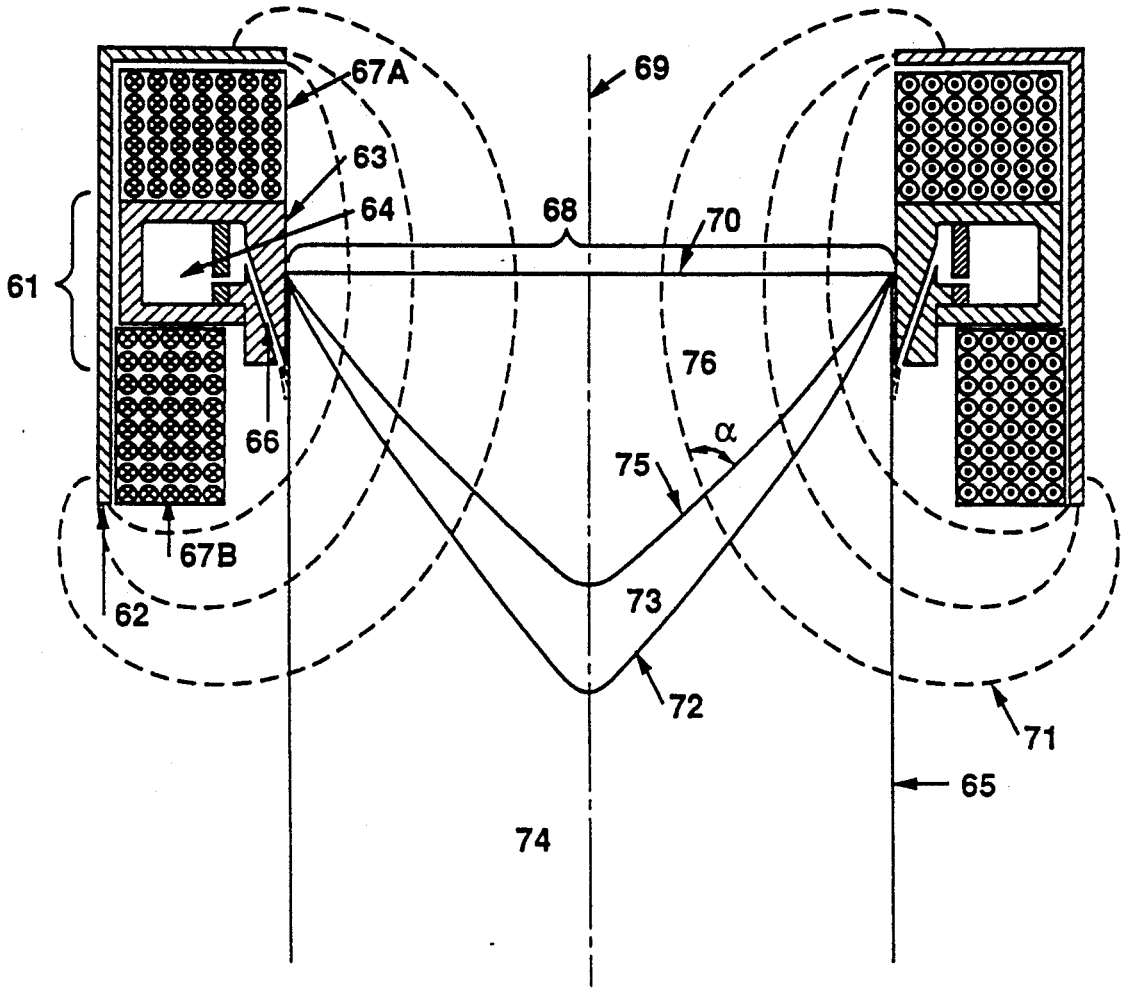
FIG. 1(D) shows a schematic cross-section of a form of the apparatus of this invention having coil means positioned around the exterior of the casting mold cavity both above and below the casting mold.

FIG. 1(D) illustrates yet another form of the direct current magnetic damping apparatus of the present invention. In FIG. 1(D), a mold 61 is shown including a steel flux path 62 and cooling means 63 that includes a water box 64. Reference numeral 65 identifies the side wall of the ingot which has emerged from the casting mold 61. Cooling water is discharged from the water box 64 and flows through passageway 66 in such a direction so as to communicate with the side wall of the ingot 65. As shown in FIG. 1(D), the field coil 67A is positioned generally above the casting mold 61, and the field coil 67B is positioned generally below the casting mold 61. Field coil 67B has a greater transverse inside dimension than the transverse inside dimension of the casting mold cavity 68. Reference numerals 69 and 70 refer to the longitudinal axis of the ingot and the melt surface, respectively It will be understood by those skilled in the art from FIG. 1(D) that the magnetic field has an axis of symmetry disposed within the casting mold cavity and oriented generally parallel to the direction of casting and that the magnetic field flux lines 71 reduce undesired convection in the molten metal alloy.

In FIG. 1(D), reference numeral 72 refers to the interface between the liquid-solid mushy zone 73 and the solid zone (solidified ingot) 74. Reference numeral 75 refers to the interface between the liquid-solid mushy zone 73 and the liquid zone (pool) 76. The molten metal alloy which may contain a grain refining agent is introduced into the casting mold cavity. FIG. 1(D) shows that each magnetic field flux line 71 passes through a point on a line (not shown) which is tangent to the interface between the liquid-solid mushy zone 73 and the liquid zone 76 at an angle $\alpha$, that is greater than about 20 degrees.

Another embodiment of this invention includes an ingot having a refined equiaxed grain structure and reduced pore size. This ingot is produced in accordance with the process of this invention. FIGS. 2, 3A, 3B, and 3C show the effect of a substantially static direct current magnetic field on ingot centerline macrosegregation in the casting of 16 inch by 50 inch ingots of various alloys refined with an aluminum, 5% titanium, 0.2% boron grain refiner. Samples of each alloy were analyzed for alloy element concentration and the data was plotted as shown in FIGS. 2, 3A, 3B, and 3C.

Figure 2:
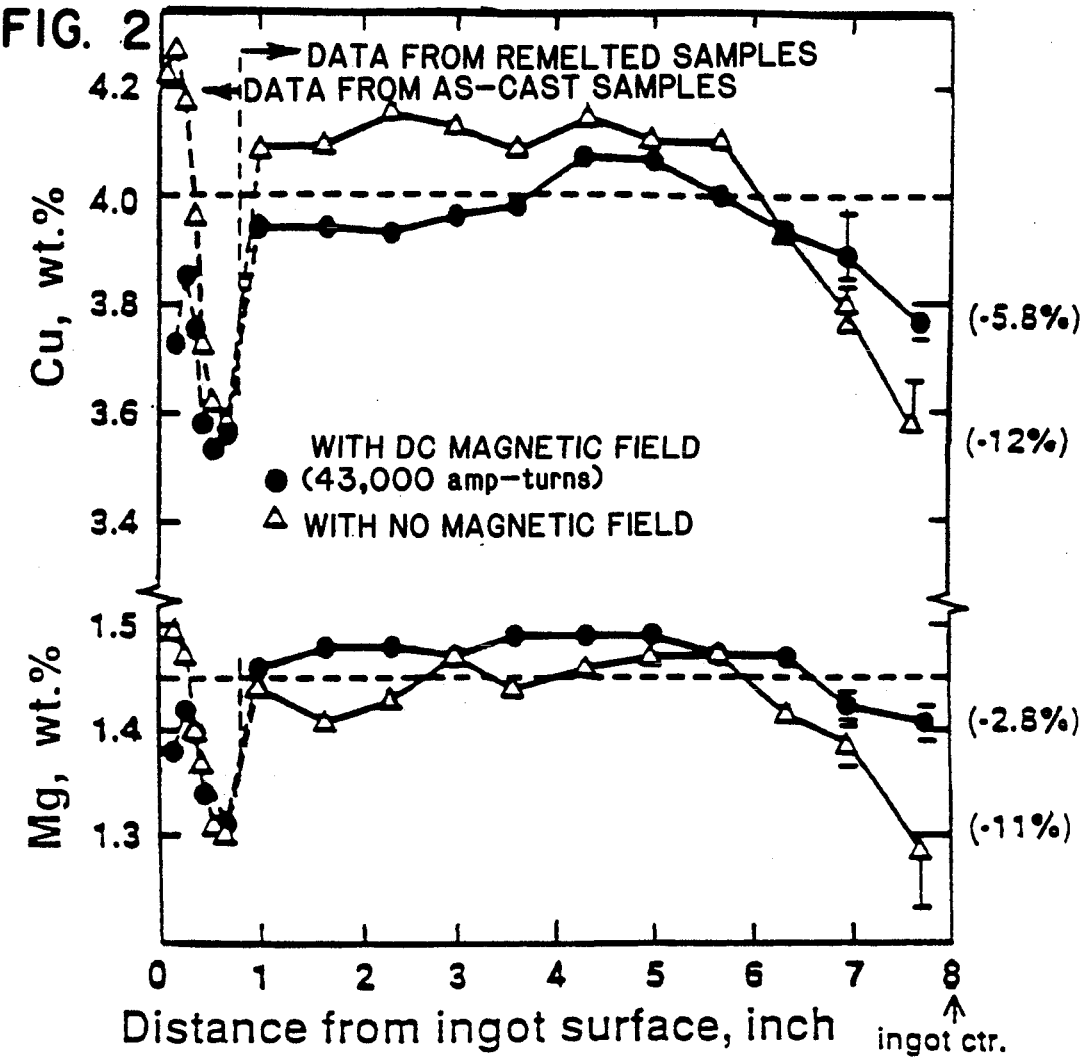
FIG. 2 shows the effect of a substantially static magnetic field (direct current) on ingot macrosegregation in 2124 alloy.

FIG. 2 shows the concentration of copper and magnesium in a 2124 alloy plotted as a function of distance from the ingot surface FIG. 2 indicates the −5.8% deviation in ingot centerline composition occurred with respect to the copper concentration shown in weight percent (wt %) of copper charged to the casting when a substantially static direct current magnetic field was employed in the casting process. FIG. 2 indicates that a −12% deviation occurred with respect to the copper concentration when no magnetic field was employed in the casting process. It will be appreciated, therefore, that approximately a 50% reduction of ingot centerline ($C_L$) macrosegregation of copper in alloy 2124 was achieved employing the process of this invention. In regard to magnesium concentration, approximately a 75% reduction of ingot centerline macrosegregation of magnesium in alloy 2124 was achieved when the substantially static direct current magnetic field was applied. Unexpected benefits, not shown in FIG. 2, including improved alloy grain refinement and reduced pore size in the alloy were also achieved.

Figure 3A:
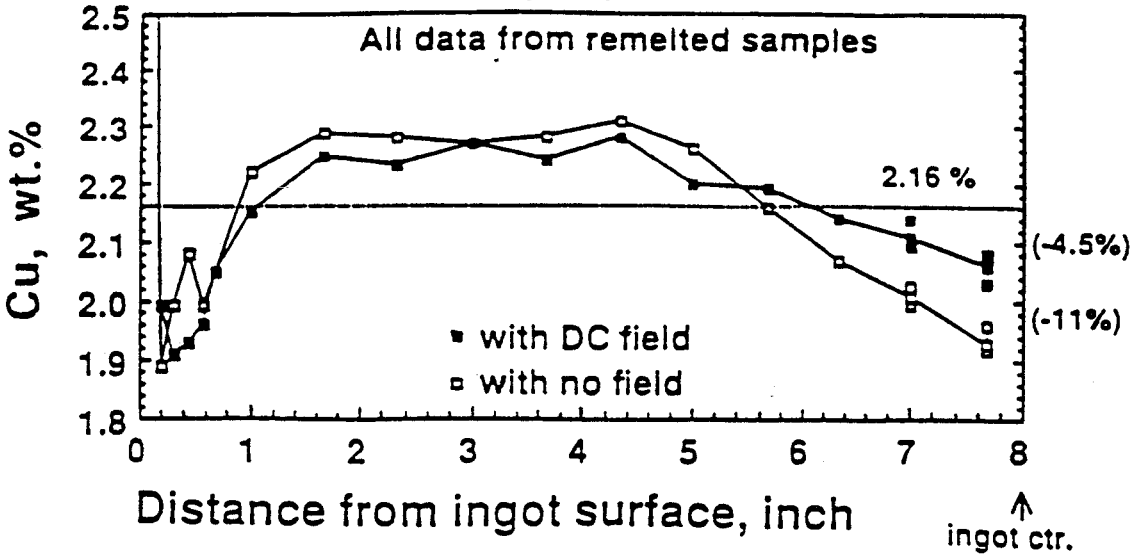
FIGS. 3A, 3B and 3C show the effect of a substantially static magnetic field (direct current) on ingot macrosegregation in 7050 alloy.
Figure 3B:
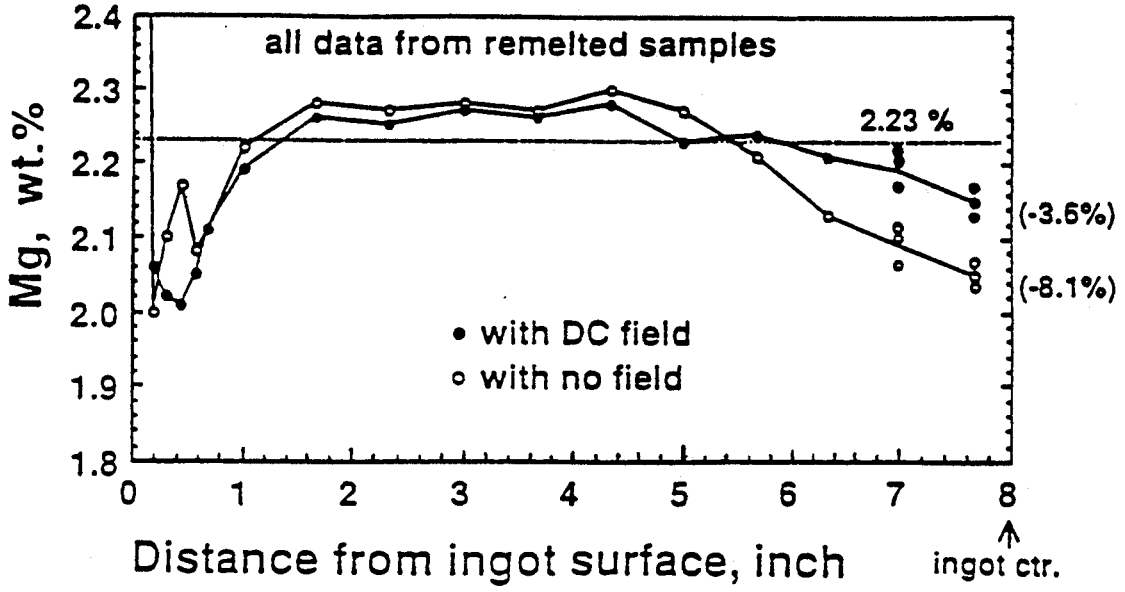
Figure 3C:
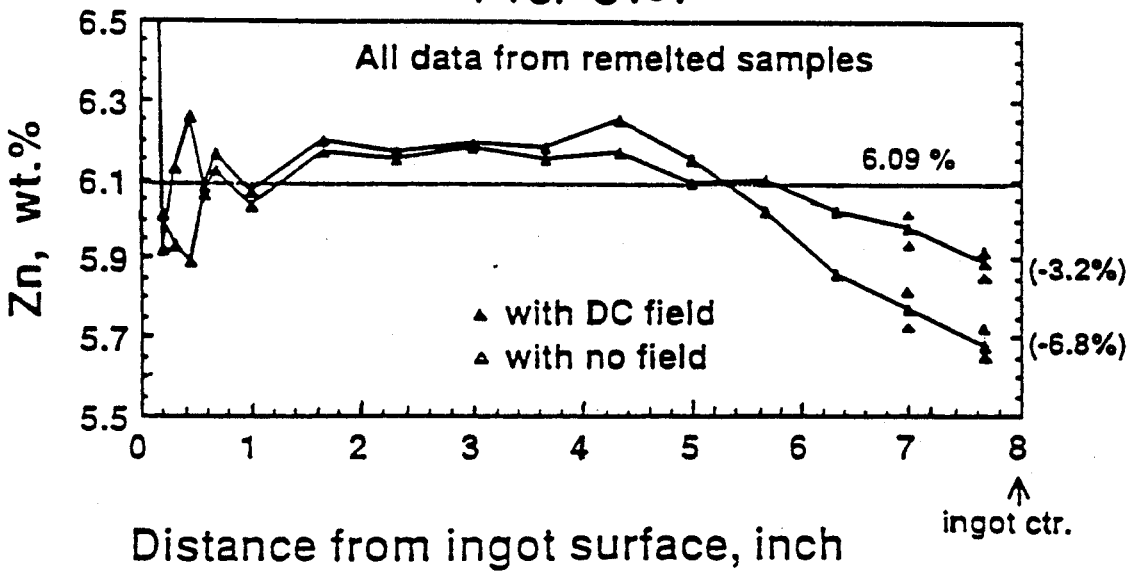

FIGS. 3A, 3B and 3C show the effect of a substantially static direct current magnetic field on macrosegregation of Cu, Mg and Zn, respectively, in the casting of a 16 inch by 50 inch ingot of a 7050 alloy refined with an aluminum, 5% titanium, 0.2% boron grain refiner.

Based on the deviation ingot centerline composition shown in FIG. 3A, approximately a 60% reduction of ingot centerline macrosegregation of copper in alloy 7050 was achieved employing the process of this invention. Approximately a 55% (FIG. 3B) and 50% (FIG. 3C) reduction of ingot centerline macrosegregation of magnesium and zinc (Zn), respectively, in alloy 7050 occurred when the process of this invention was employed.

In order to provide a further understanding of the nature of this invention, a specific example is provided.

EXAMPLE

This invention provides a water cooled mold having a rectangular mold cavity which is about 16 inches by 50 inches. The mold height is about 5 inches. A coil of copper tubing is wound around the exterior of the mold cavity. The inner surface of this coil is spaced about 2 centimeters to 6 centimeters from the exterior of the mold cavity. The copper tubing has an outside diameter of about 0.50 centimeters and has 90 turns. After introduction of the molten 7050 aluminum alloy into the mold cavity, cooling is initiated and the coil, which is disposed around the exterior of the mold cavity, establishes a magnetic field that is generally symmetrical with respect to the longitudinal axis of the mold cavity and that has an intensity of at least about 500 gauss. This magnetic field serves to resist undesired macrosegregation in the aluminum alloy.

As is known in the casting process, in order to form a generally hollow portion in the casting, a core is provided in the mold cavity. The molten metal is poured into the mold and flow around the core to form the hollow portion. The invention can readily be employed with a mold cavity employing a core for forming a hollow portion in the casting.

It will be appreciated by those persons skilled in the art that this invention provides a process and apparatus for reducing undesired macrosegregation in the casting of a metal alloy ingot. The resultant improved ingot advantageously has a refined equiaxed grain structure and a reduced pore size. It will be understood from the hereinbefore described invention that this process reduces undesired convection of alloy constituents in molten metal alloys and imposes a substantially static magnetic field having at least two planes of symmetry which intersect on the longitudinal axis of the ingot.

Whereas particular embodiments of the invention have been described herein for purpose of illustration, it will be evident to those skilled in the art that numerous variations of the details of the present invention may be made without departing from the invention as defined in the appended claims.

What is claimed is:

1. A process of reducing macrosegregation in the casting of aluminum alloy ingot comprising:
   - introducing a molten aluminum alloy into a casting mold cavity;
   - cooling said molten aluminum alloy to form a solid zone, a liquid-solid mushy zone overlying said solid zone, a liquid zone overlying said liquid-solid mushy zone and a melt surface on said liquid zone;
   - employing during said cooling at least one substantially static magnetic field having at least two planes of symmetry which intersect on the longitudinal axis of said ingot;
   - generating said magnetic field by at least one coil means having an inner region through which said aluminum alloy passes;
   - energizing said coil means by a substantially static electrical current wherein said current follows in a path defined by said coil means and passes around at least one of said molten aluminum alloy and said zones;
   - dampening convection flows of said molten aluminum alloy which cause macrosegregation by means of said magnetic field; and
   - passing a magnetic field flux line through a point on a line which is tangent to the interface between said liquid-solid mushy zone and said liquid zone at an angle greater than about 20 degrees.

2. The process of claim 1 including mixing a grain refining agent with said molten aluminum alloy prior to introducing said molten aluminum alloy into a casting mold.

3. The process of claim 1 including forming said ingot in a continuous casting mold.

4. The process of claim 1 including forming said ingot in a semi-continuous casting mold.

5. The process of claim 1 including positioning at least one oil means generally above said mold cavity.

6. The process of claim 1 including positioning at least one coil means generally below said mold cavity.

7. The process of claim 6 including positioning an inner surface of said coil means within about 2 centimeters to 6 centimeters from an outer surface of said ingot.

8. The process of claim 1 including positioning at least one coil means generally around the exterior of said mold cavity.

9. The process of claim 1 including positioning at least one coil means generally around the exterior of said mold cavity and in part below said mold cavity.

10. The process of claim 1 including positioning a plurality of coil means in at least one of the positions selected from the group consisting of (A) generally below said mold cavity, (B) generally above said mold cavity, (C) generally around the exterior of said mold cavity, and (D) generally around the exterior of said mold cavity and in part below said mold cavity, and combinations thereof.

11. The process of claim 10 including employing said electric current in each of said coil means in the same direction.

12. The process of claim 1 including providing said magnetic field having an intensity of at least about 500 gauss.

13. The process of claim 1 including casting said ingot in a generally circular mold cavity.

14. The process of claim 1 including casting said ingot in a generally noncircular shaped mold cavity wherein said shape is selected from the group consisting of rectangular, square, and elliptical.

15. The process of claim 14 including casting said ingot in a generally rectangular mold cavity.

16. The process of claim 15 including casting said ingot in a generally square mold cavity.

17. The process of claim 14 including casting said ingot in a generally elliptical mold cavity.

18. The process of claim 1 including providing core means within said mold cavity for producing an ingot having a hollow portion.

19. The process of claim 1 including employing an aluminum alloy selected from the group consisting of 2xxx, 3xxx, 5xxx and 7xxx alloy series.

20. The process of claim 9 including employing said process resulting in said ingot having a refined equiaxed grain structure.

21. The process of claim 19 including employing said process resulting in said ingot having a reduced pore size.

* * * * *